US009961944B2

(12) United States Patent
Fayad

(10) Patent No.: US 9,961,944 B2
(45) Date of Patent: May 8, 2018

(54) MULTI-ADJUSTABLE BACKLESS BRA

(71) Applicant: Fadwa Fayad, Potomac, MD (US)

(72) Inventor: Fadwa Fayad, Potomac, MD (US)

( * ) Notice: Subject to any disclaimer, the term of this patent is extended or adjusted under 35 U.S.C. 154(b) by 0 days. days.

(21) Appl. No.: 15/160,360

(22) Filed: May 20, 2016

(65) Prior Publication Data

US 2016/0338419 A1 Nov. 24, 2016

Related U.S. Application Data

(60) Provisional application No. 62/165,260, filed on May 22, 2015.

(51) Int. Cl.
*A41C 3/00* (2006.01)
*A41F 15/00* (2006.01)

(52) U.S. Cl.
CPC ..... *A41C 3/0028* (2013.01); *A41C 3/0078* (2013.01); *A41F 15/002* (2013.01)

(58) Field of Classification Search
CPC ... A41C 3/0028; A41C 3/0078; A41C 3/0021; A41C 3/00; A41C 3/02
USPC ..... 450/1, 88, 81, 86, 85
See application file for complete search history.

(56) References Cited

U.S. PATENT DOCUMENTS 1,871,106 A 12/1931 Yerkes
2,542,881 A 6/1948 Ries
3,077,885 A * 2/1963 Hopper ..... A41C 3/0078 450/86
3,407,819 A 7/1966 Barnes
3,465,754 A * 9/1969 Lockwood ..... A41C 3/00 450/1
4,411,269 A * 10/1983 Weintraub ..... A41C 3/02 450/58
6,547,636 B1 4/2003 Cato
6,857,936 B2 * 2/2005 Jones ..... A41F 15/002 450/86
7,168,096 B1 * 1/2007 Landa ..... A41D 7/00 2/67
8,075,369 B2 * 12/2011 Hendrickson ..... A41C 3/0028 450/86
2003/0003844 A1 1/2003 Jones et al.
2010/0190411 A1 * 7/2010 Saraceno ..... A41C 3/02 450/39
2011/0081827 A1 * 4/2011 Williams ..... A41C 3/0021 450/65
2013/0237124 A1 * 9/2013 Hall ..... A41C 3/00 450/38

FOREIGN PATENT DOCUMENTS

AU 69866/98 B 9/1998
GB 2 376 171 A 12/2002

* cited by examiner

*Primary Examiner* — Gloria Hale
(74) *Attorney, Agent, or Firm* — Sughrue Mion, PLLC

(57) ABSTRACT

This invention relates to a multi-adjustable bra which is constructed for adequate support of the breasts yet permitting it to be worn with backless, strapless, and/or halter neck evening gowns, dresses or tops without disclosing unsightly straps either across the back or over the shoulders of the wearer.

6 Claims, 14 Drawing Sheets

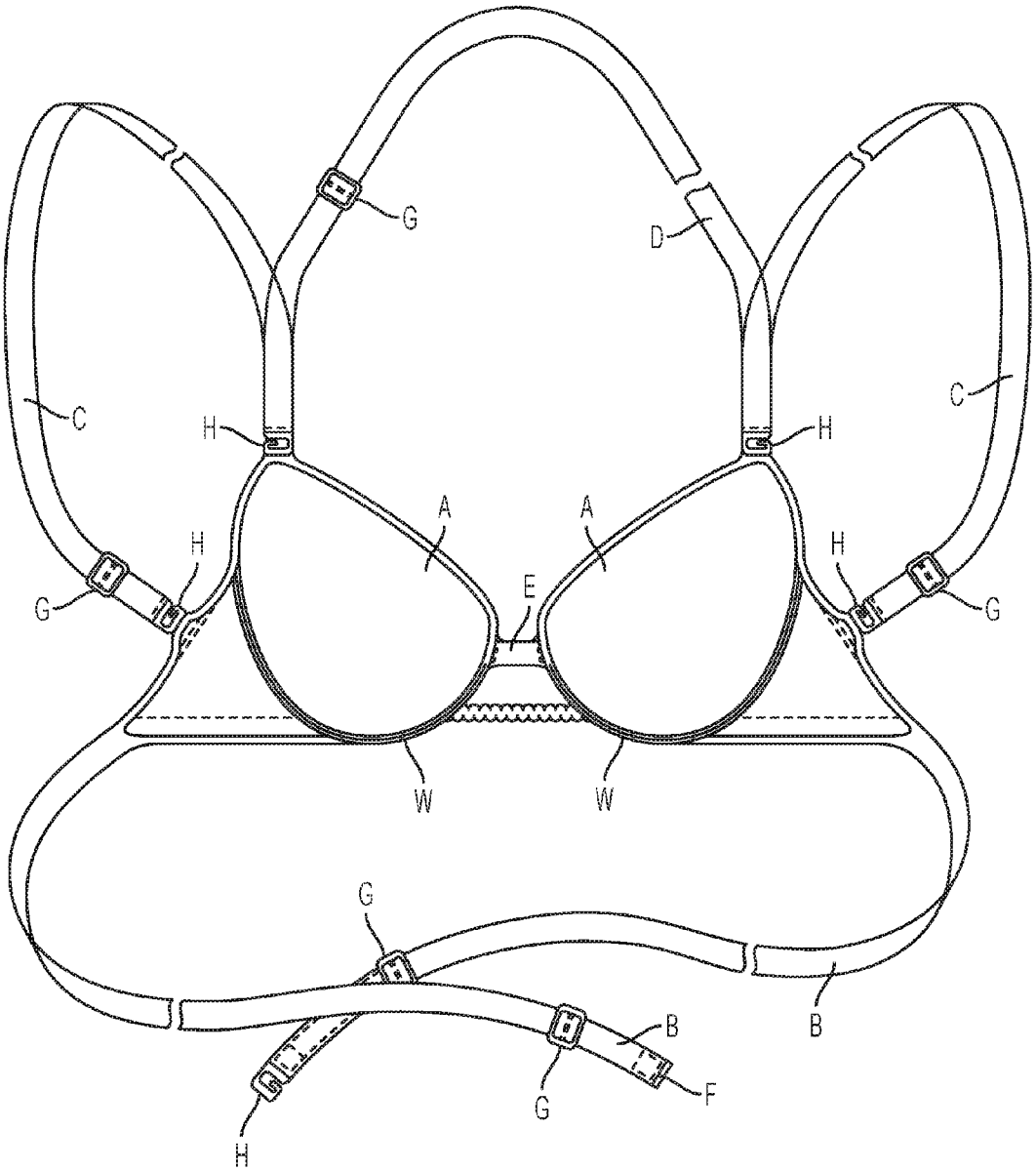
FIG. 1 (A & B)

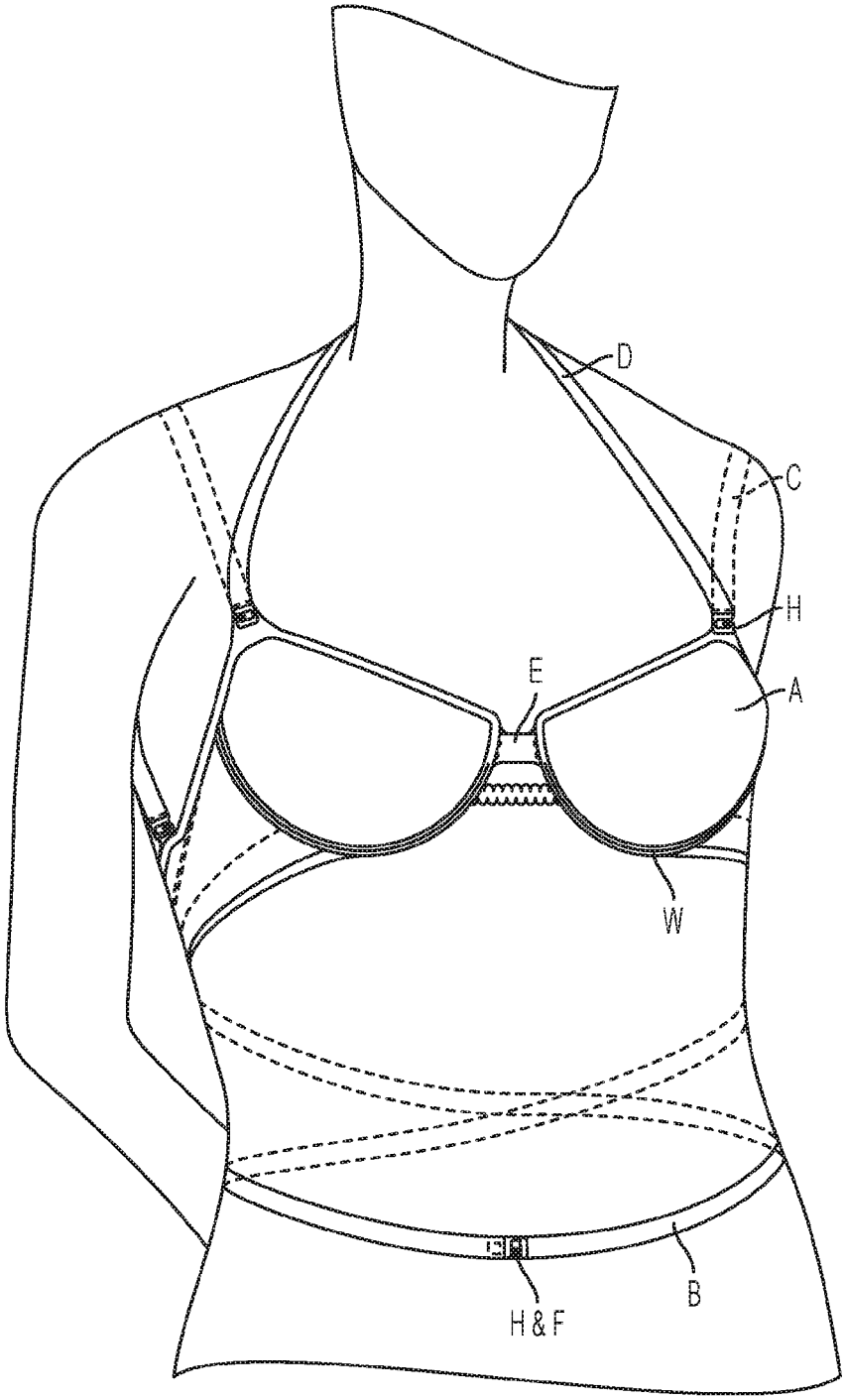
FIG. 2 (A & B)

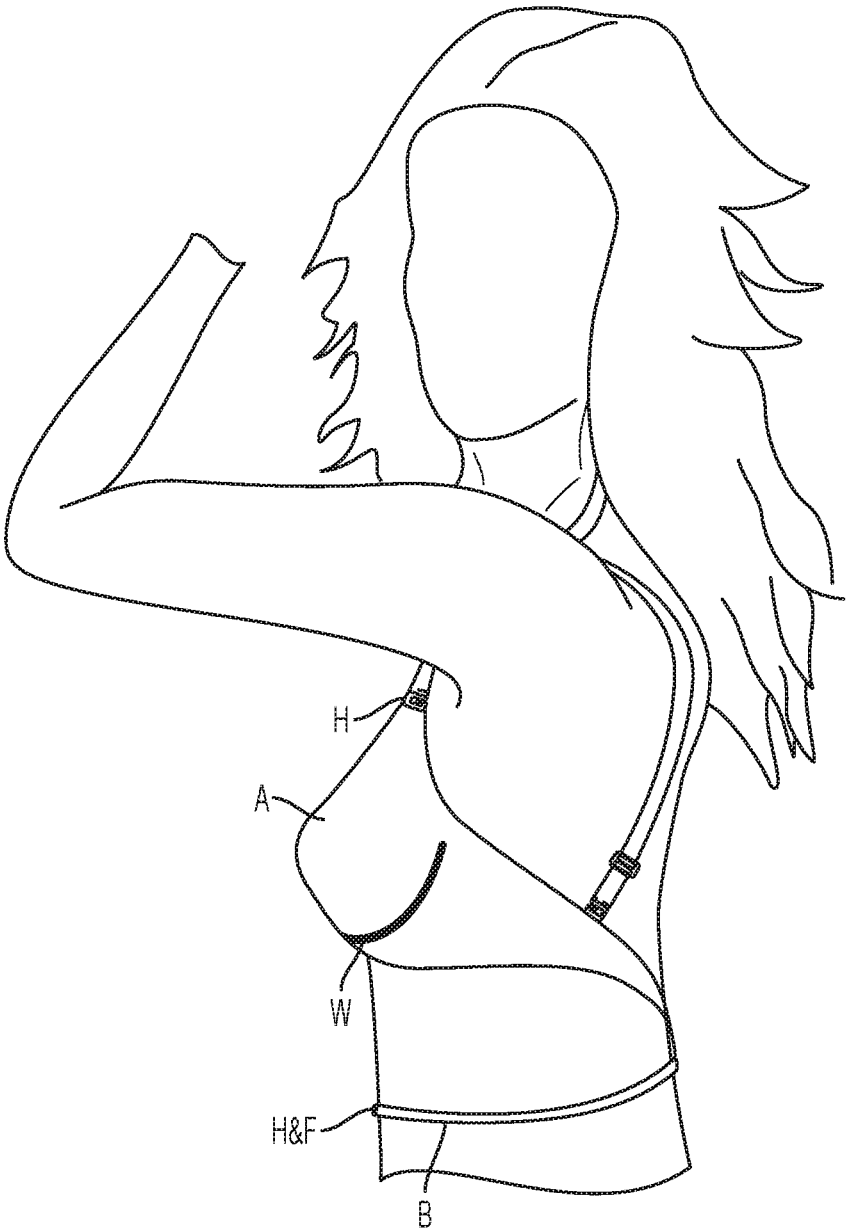
FIG. 3 (A & B)

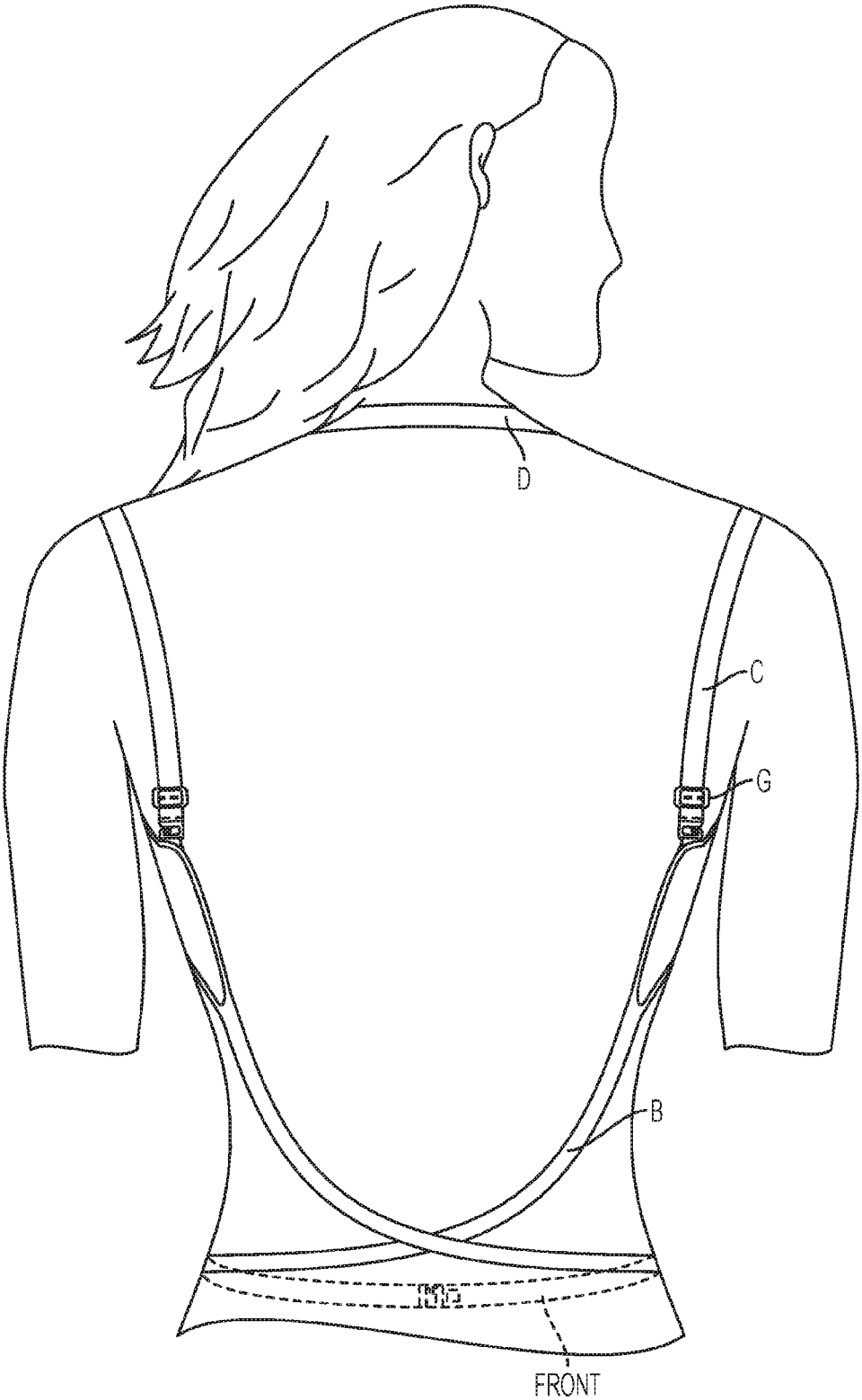
FIG. 4 (A & B)

MULTI-ADJUSTABLE BACKLESS BRA

CROSS-REFERENCE TO RELATED APPLICATIONS

The present application claims benefit of U.S. Provisional Application Ser. No. 62/165,260 filed on May 22, 2015; the entire contents of which are incorporated herein by reference.

BACKGROUND OF THE INVENTION

The present invention relates generally to a breast support apparatus (referred to as a brassiere or bra) for use with any garment. More particularly the present invention relates to an improved convertible and adjustable configuration of a bra with shoulder straps to a backless bra to provide increased versatility, convenient use and comfortable support to the breast when wearing apparel designed to reveal the back of the human body as bare.

Brassieres ("bras") are generally undergarments that a wearer wants to conceal, and which are worn to contour and support the breasts. Women are constantly seeking comfortable bras that are appropriate for different styles of apparel, especially backless apparel and strapless, or halter neck evening gowns, dresses or tops without disclosing unsightly straps either across the back or over the shoulders of the wearer. Women with larger breasts are faced with certain fashion limitations and often will not purchase backless apparel for public wear due to lack of support to the breasts and/or the exposed look of the breasts from the external appearance of the garment.

In the prior art, numerous attempts at alleviating these problems have been promulgated. A backless and strapless bra is a device known in the art and worn under clothing when a bra with traditional shoulder straps would appear under the clothing and detract from the appearance of the clothing. For example, U.S. Pat. No. 1,871,106 provides a backless and strapless bra where the attaching straps are crossed down on the back of the wearer and brought to the front at the waist line so that shoulder straps are not required. However, this design is not convertible or adjustable to be worn in a normal fashion with shoulder straps. The lack of the shoulder straps will limit the wearer's ability to extend the range of how low the bands can cross around the back while maintaining the bra in place.

U.S. Pat. No. 2,542,881 describes a bra comprising a neck band and wrap around waist bands, thus eliminating undesirable shoulder straps. However, this bra has no under wire support. It has a flat wedge material and design that leads to a flat contour. The halter band is also permanently connected to the apex of the bra and shoulder straps have been eliminated, making the bra non-configurable for alternate wear. Further, the bra uses tape for fastening the bra to the body of the wearer to compensate for the lack of the support mechanism and design as found in this bra.

U.S. Pat. No. 3,407,819 describes a self-adjusting bra which is capable of being used in the normal fashion and at the same time, adapted for use with backless dresses. However, this design does not allow for detaching the straps and/or repositioning of the straps for other alternative styles and configurations, such as a halter-type configuration. This bra has a back body band that is firmly connected to the preformed cup. The shoulder straps are not removable or adjustable, yet are formed into a loop around the back band and can only be repositioned by sliding the straps along the back band. The design is to stretch the rear mid section of the back strap to be removable attached to the upper edge of a panty girdle, girdle or anything else in the region of the lower back by means of a tape or adhesive. It does not provide for a secure and stable configuration since the undergarments of wearer are the determining factor for holding the bra in position. This connection will lead to either the undergarment being exposed as a result of the tension forces with the elasticity of the band or a compromise of the bust support by the downward pull of the back band.

U.S. Pat. No. 6,547,636 provides a convertible bra that converts from a general bra to a backless configuration, by concealing the unattached horizontal back straps by placing the extending ends within open vertical slits inside the brassiere cup. This modification causes significant material clutter within the cups of the wearer. Additionally, the shoulder straps are the only support for the breast, which is insufficient. Without securing the back, the front lower end of the cups will either pull up or the shoulder straps will slip off and fall over and forward with the cups. This design also does not allow for detaching the straps and/or repositioning of the straps for other alternative styles and configurations, such as a halter-type configuration.

U.S. Pat. No. 3,077,885 provides a backless bra including detachable and adjustable straps; however, the straps are attached from the bra to the girdle of the wearer. AU 9869866 describes clip on adjustable bra straps that can be clipped on in a variety of positions to the bra fabric by releasable clips without any part of the clip being included in the fabric. However, such a construction would not be considered sturdy and reliable, particularly in the case of a larger and heavier wearer.

US 2011/0081827 provides a bra having a diagonal strap mechanism wherein the strap passes around the neck in a halter like fashion or instead of passing behind the neck, it continues down the back, crosses in the middle and around the body to fasten in the front. In this design, the straps are visible and undesirable for a totally strapless and backless garment.

US 2003/0003844 provides a bra capable of being secured to an individual by a variety of straps formed in multiple configurations. This design, despite it's interchangeable capabilities is suitable for beachwear or can be independently worn as a top. The adjustability of the bra to size is achieved by running the straps into and out of the wearer's cups using a lengthy band that constitutes a bulky addition to the breast support piece, which in turn is formed as an integral one-piece construction of fabric. The back straps are adapted to extend from the breast support piece instead of being detachable and adjustable. The back and shoulder straps are also secured by tying the ends into knots, or by pieces of add-on fasteners, secondary and tertiary connectors and/or by components that complicate the design objective. While complicated, this design approach offers interchangeability, but does not provide shape and sufficient support of the bust.

GB 2376171 describes a bra for use with backless, strapless and halter-neck dresses and tops having cups held together by a front clasp including length adjustable and detachable shoulder and back straps. This bra does not meet the requirements of a backless bra because the back strap is still in existence, only to be made of a plastic transparent material. The fact that the back band is fixed to the cups and is neither detachable nor adjustable renders it readily visible.

Backless and strapless bras secured to the breast area by adhesive substances to support and cover the breasts are also known in the art. Generally, backless and strapless bras known in the prior art are garments comprised of two cups and connecting material as well as some extraneous material around the cups of the bra extending toward the underarm area. These garments, known in the prior art, provide contouring and a smooth appearance or silhouette to the breasts under clothing, and may also contain padding to further enhance the appearance and shape of the breasts. However, because straps are not present, there is no upward support or counter-pressure to counteract gravity resulting in an unsupported appearance of the breasts. Accordingly, backless and strapless bras known in the art have traditionally provided limited support for breasts because of the absence of straps. Thus, women who desire supportive bras are often deterred from wearing backless, strapless bras, and are thus limited in their ability to wear backless and strapless styles of clothing. There is a significant market segment of women desiring the support of a traditional bra having straps, but who would like to wear backless and/or strapless clothing.

A further drawback of strapless adhesive bras, in addition to the loss of support, is the inability to launder the garment. Generally, adhesives which hold strapless bras in place lose their effectiveness upon exposure to moisture, humidity and turbidity while being worn or during the laundering process.

Still another drawback of the prior art is the use of adhesives which are insufficient to hold a garment in place, given the counter-pressure of the breasts being supported, for substantial periods of time (e.g., more than a few hours).

It is desirable to have a bra which provides support and counterforce of a type and/or in a manner similar to traditional bras having back and/or shoulder straps, but which does not have visible support structures such as straps.

In accordance with the present invention, there has been provided an improved construction of the bra that successfully accommodates the diverse wardrobe of the wearer because it can be worn in multiple fashions, including as a bra with shoulder straps and in the backless configuration and/or halter configuration. The wearer saves money because only one bra is purchased instead of multiple bras for various fashions. Women will feel more confident in backless apparel knowing that their breasts are well supported. Also, due to the adjustable band strap capability, this bra allows for the wearer to seek only the cup size in determining the bra size and would eliminate the need to couple the cup size with the waist or bust circumference (i.e., the user will seek to purchase a cup size of A, B, C, D or E cup instead of the conventional 32A, 32B, 32C, etc . . . ).

SUMMARY OF THE INVENTION

This invention relates to a multi-adjustable bra which is constructed for adequate support of the breasts yet permitting it to be worn with backless and strapless, or halter neck evening gowns, dresses or tops without disclosing unsightly straps either across the back or over the shoulders of the wearer.

The adjustable bra of the present invention includes an adjustment element that permits:

Transforming from a backless bra with shoulder straps to a backless bra with halter-neck straps;

Adjustment of the length of the halter-neck straps;

Adjustment of the length of the shoulder straps;

Adjustment of the length of a band that fastens the bra on the wearer; and

Adjustment of the cup distance.

One of the object of this invention is the provision of a bra which is adapted to conform to the contour of the wearer's body.

Another object of this invention is the provision of a bra adapted to adjustably conform to the shape of the bust and the size of the cup. The construction incorporates means of securing the bra to the body without slipping or the use of adhesive material.

Another object of this invention is to provide a bra that can be worn with different configurations such as a shoulder-strap/backless configuration and a halter-neck/backless configuration and is not visible when worn with such apparel.

Another object of this invention is to provide a bra that provides support and comfort to the breasts when worn in different configurations, especially shoulder-strap/backless and/or halter-neck backless configurations.

One embodiment of the present invention is [1] a multi-adjustable backless bra comprising:

two form-shaping cups, each comprising a reinforcing underwire and each cup having an inward facing end and an outward facing end, wherein the inward facing ends of the cups generally face each other;

an under bust band underlying the form-shaping cups and which attaches to and connects the form-shaping cups;

two side portions, one connected to the outward facing end of one of the two cups and the other connected to the outward facing end of the other cup;

back body band straps extending to the lower back of the wearer and looping around to the front of the torso of the wearer, where the back body band strap ends join to couple for closure, and the back body band straps comprise a pair of length adjustment means for independently adjusting the length of the band to the circumference of the wearer; and at least one detachable and adjustable strap comprising a length adjustment means and securing means, detachably connected to the form-shaping cups and/or to the upper part of the unconnected ends of the side portions.

Another embodiment of the present invention is a bra according to [1], further comprising an optional front-opening means connecting the inward facing ends of the form-shaping cups for cleavage adjustment.

Another embodiment of the present invention is a bra according to [1], comprising two detachable shoulder straps, wherein one end of each of the detachable straps is connected to a top edge of one form-shaping cup and the other end is connected to a top edge of the corresponding side portion, to form a shoulder-strap/backless configuration.

Another embodiment of the present invention is a bra according to [1], comprising two detachable shoulder straps, wherein one end of each of the detachable straps is connected to a top edge of one form-shaping cup and the other end is connected to a top edge of the opposite side portion, to form a shoulder-strap alternating crisscross backless configuration.

Another embodiment of the present invention is a bra according to [1], comprising one detachable halter strap, wherein one end of the detachable strap is connected to a top edge of one form-shaping cup and the other end of said detachable strap is connected to a top edge of the other form-shaping cup to form a halter-strap/backless configuration.

Another embodiment of the present invention is a bra according to [1], comprising one detachable shoulder strap, wherein one end of the detachable strap is connected to a top edge of one form-shaping cup and the other end is connected to a top edge of the corresponding side portion or the opposite side portion, to form a one shoulder-strap/backless configuration.

Other important objects and embodiments of the present invention will readily present themselves in the following description.

BRIEF DESCRIPTION OF THE DRAWINGS

FIGS. 1 (A&B) is a combined plan view of the details of the bra showing both configurations.

FIGS. 2 (A&B) are general front view perspectives of two embodiments of the bra according to this invention.

FIGS. 3 (A&B) are a general side view perspective of the bra.

FIGS. 4(A&B) are general rear view perspectives of the bra.

DETAILED DESCRIPTION OF THE INVENTION

Figure 1A:
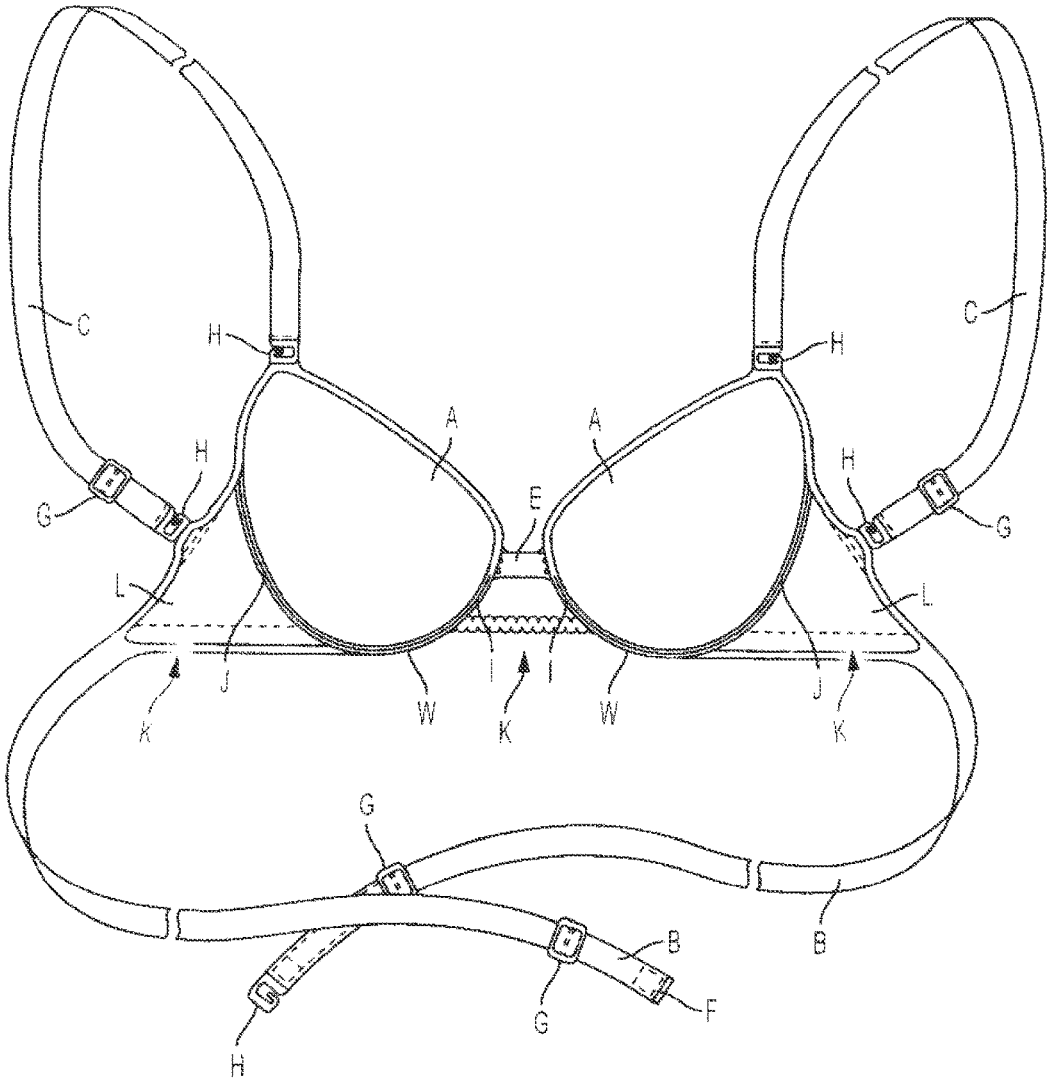
FIG. 1A is a plan view of the details of the bra showing the shoulder strap/backless configuration.
Figure 1B:
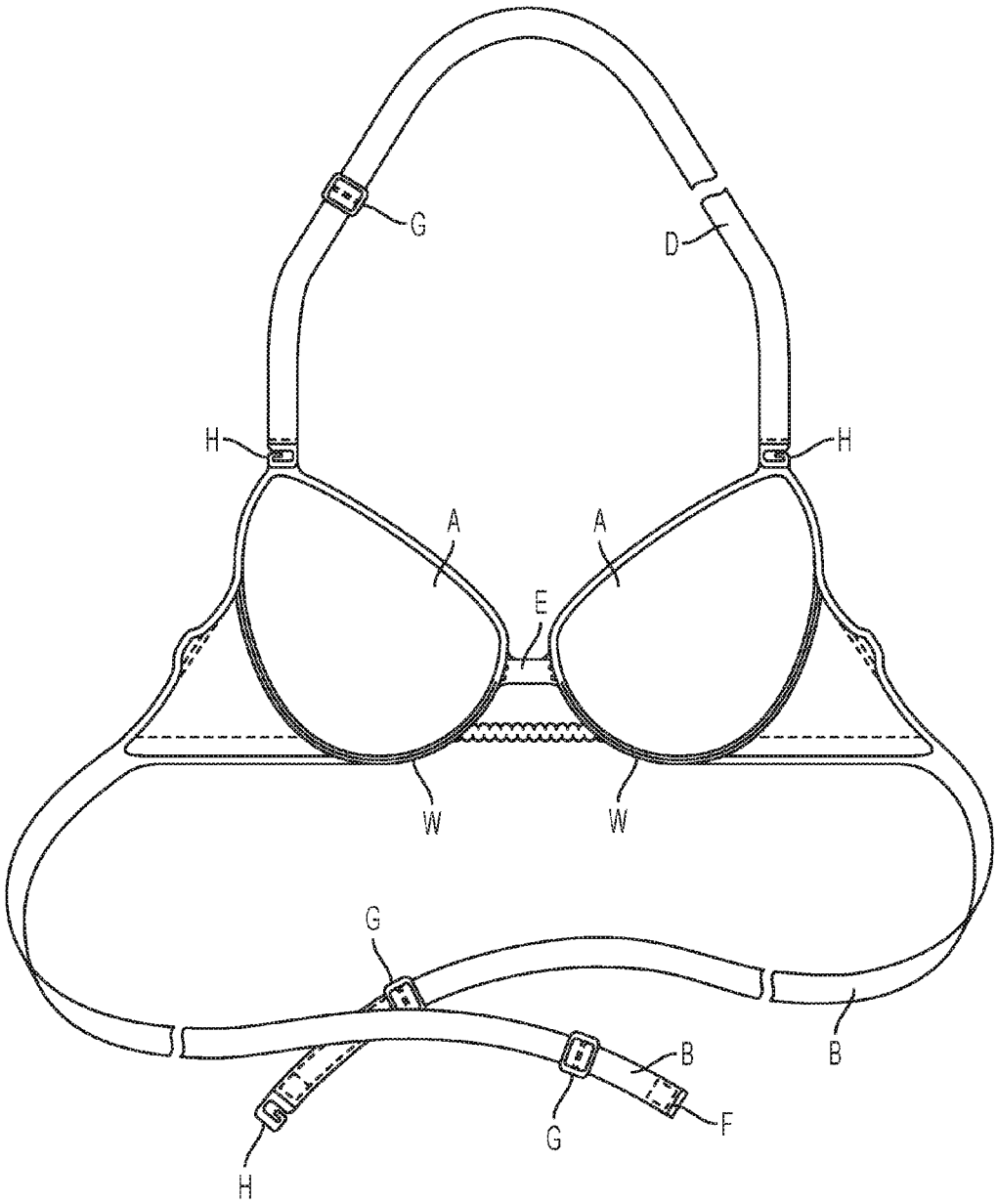
FIG. 1B is a plan view of the details of the bra showing the halter-neck/backless configuration.
Figure 2A:
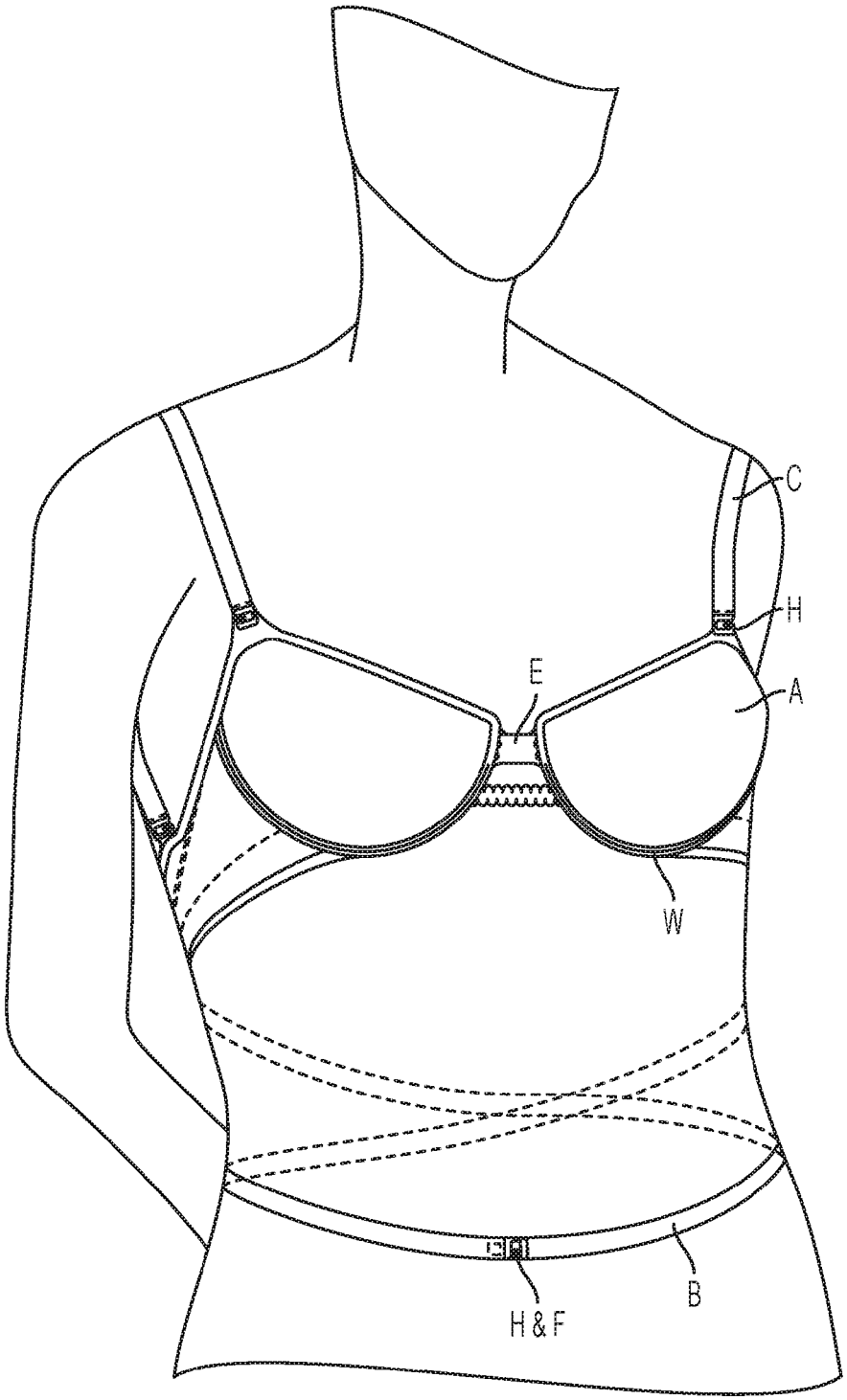
FIG. 2A is a perspective view corresponding to FIG. 1A design configuration (shoulder-strap/backless configuration).
Figure 2B:
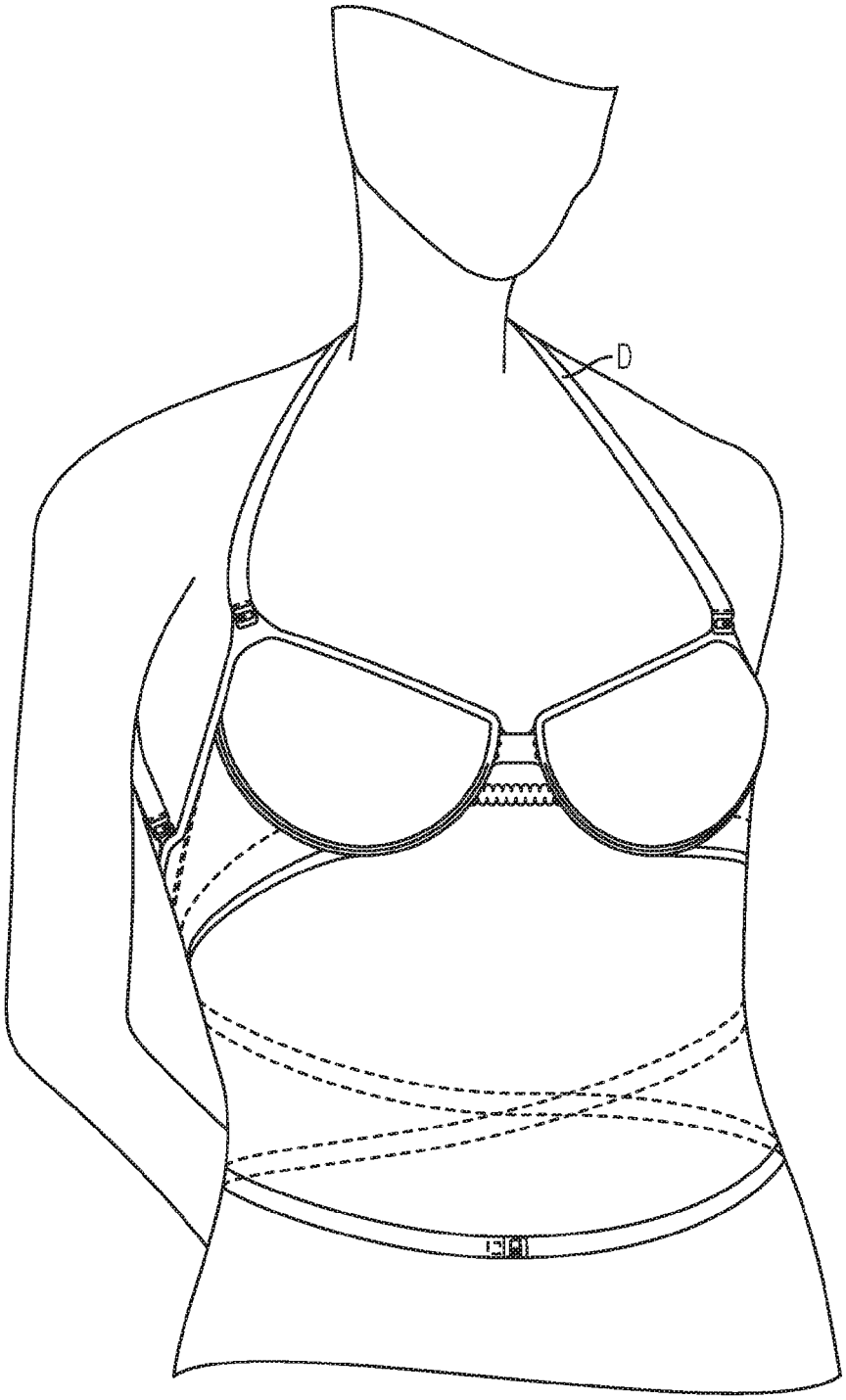
FIG. 2B is a perspective view corresponding to FIG. 1B design configuration (halter-neck/backless configuration).
Figure 3A:
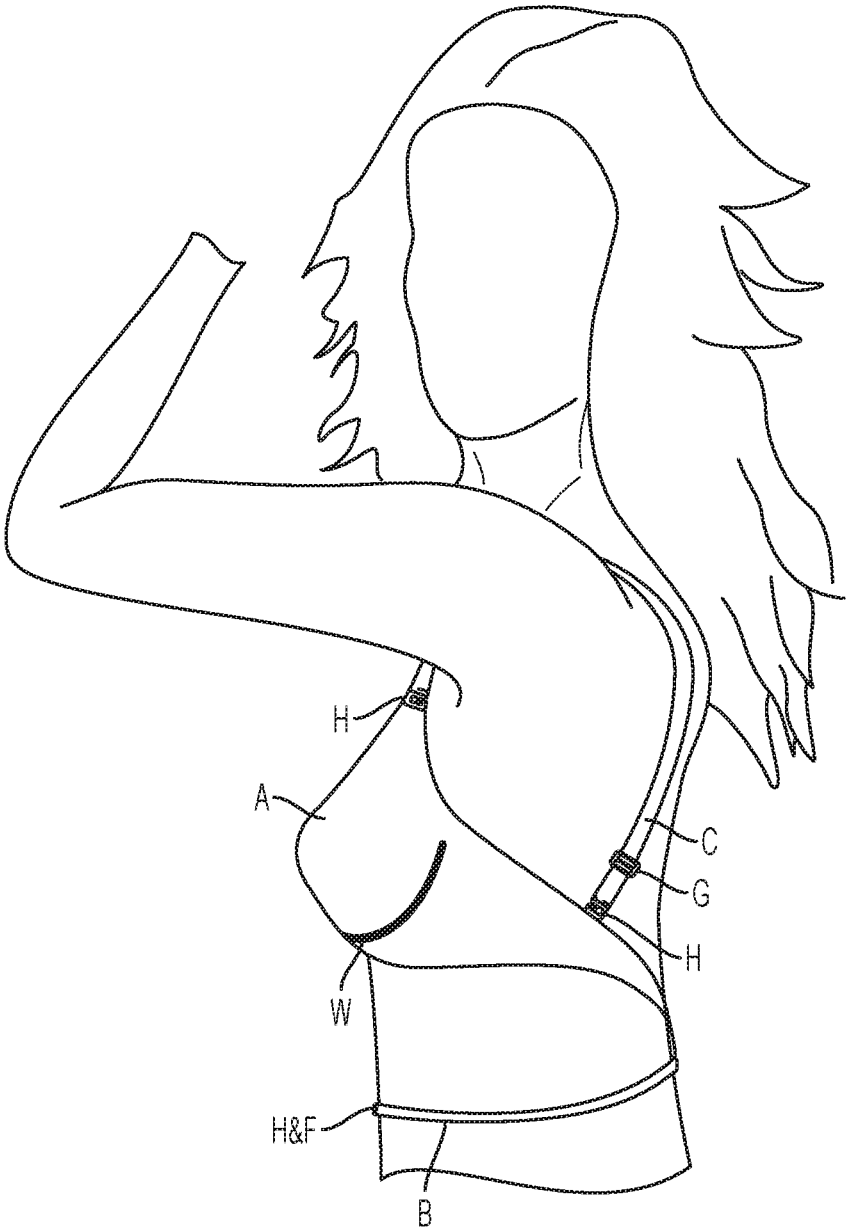
FIG. 3A is a side view perspective corresponding to FIG. 1A design configuration (shoulder-strap/backless configuration).
Figure 3B:
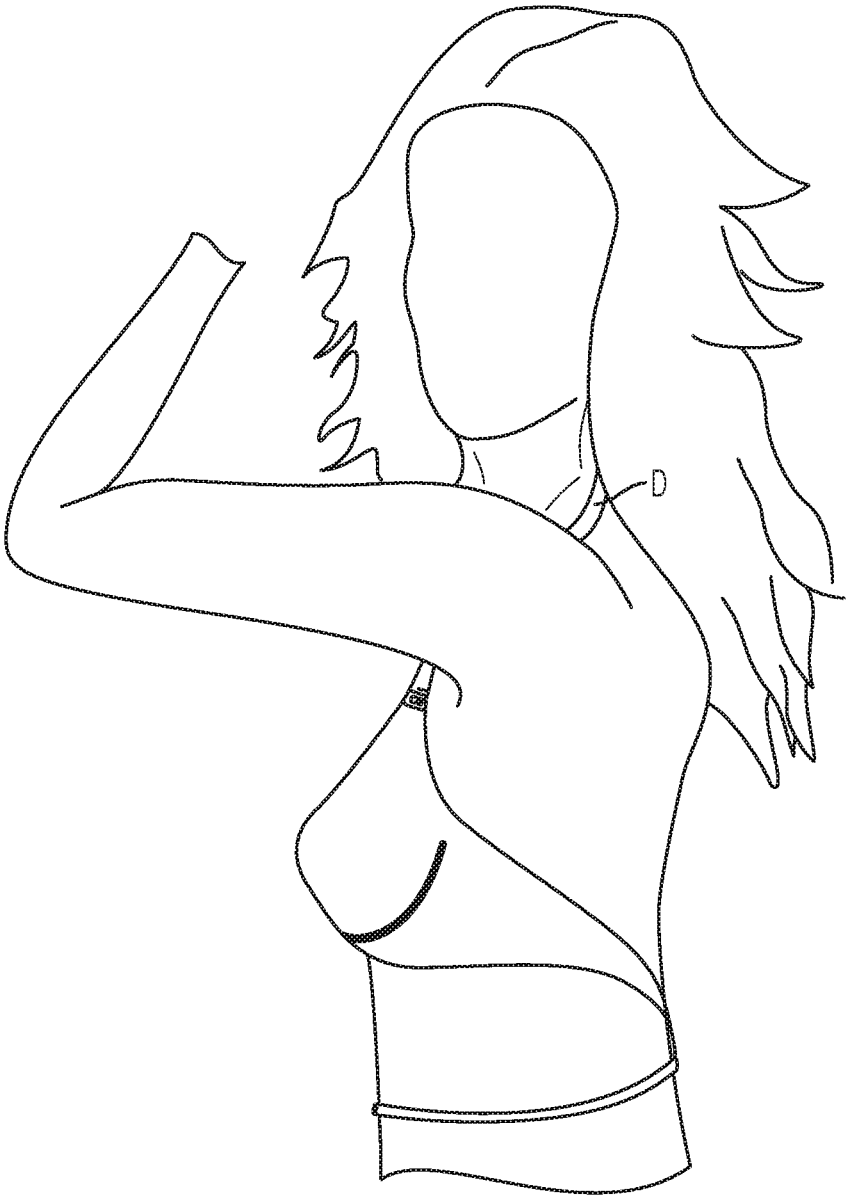
FIG. 3B is a side view perspective corresponding to FIG. 1B design configuration (halter-neck/backless configuration).
Figure 4A:
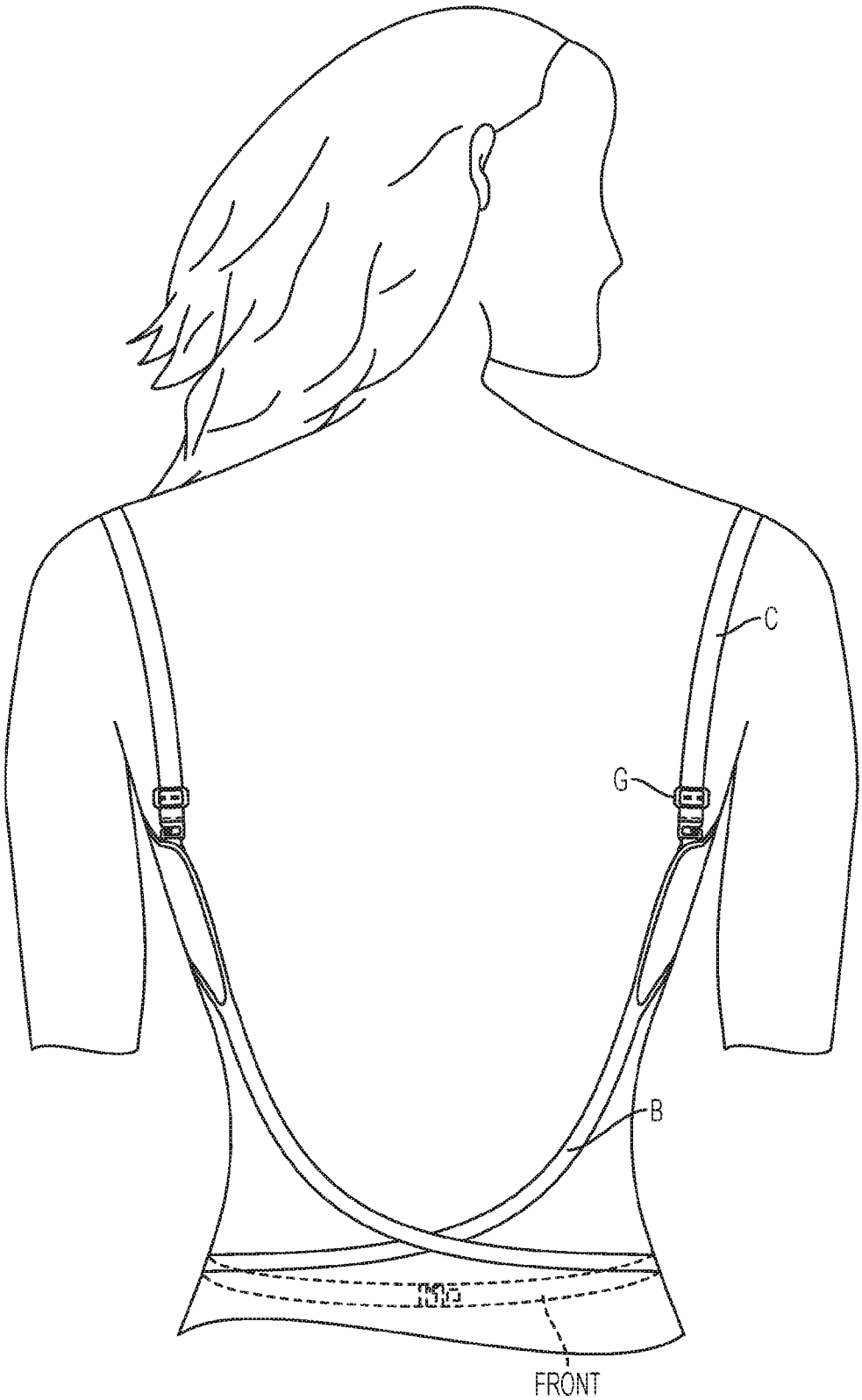
FIG. 4A is a rear view perspective corresponding to FIG. 1A design configuration (shoulder-strap/backless configuration).
Figure 4B:
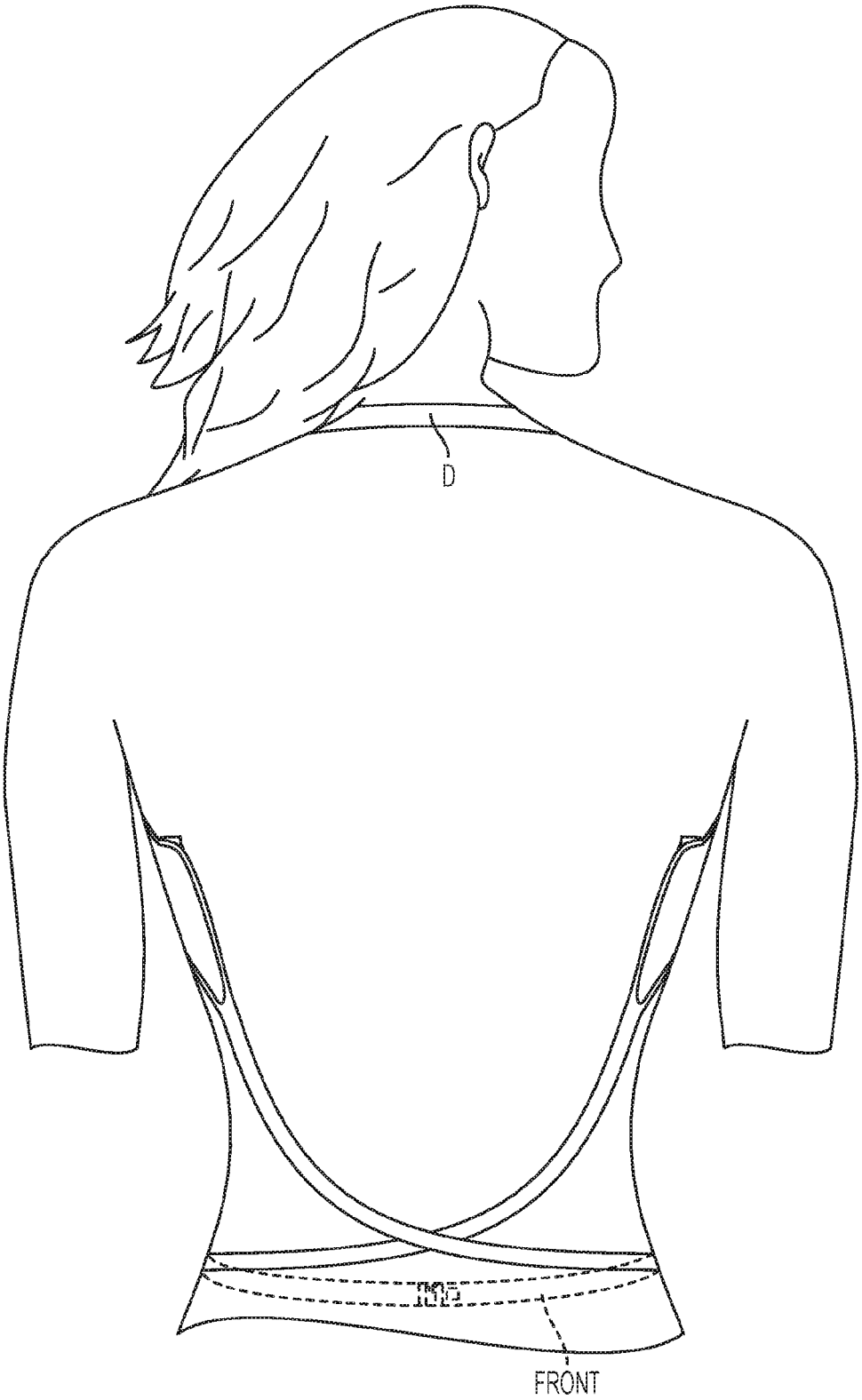
FIG. 4B is a rear view perspective corresponding to FIG. 1B design configuration (halter-neck/backless configuration).
Figure 4C:
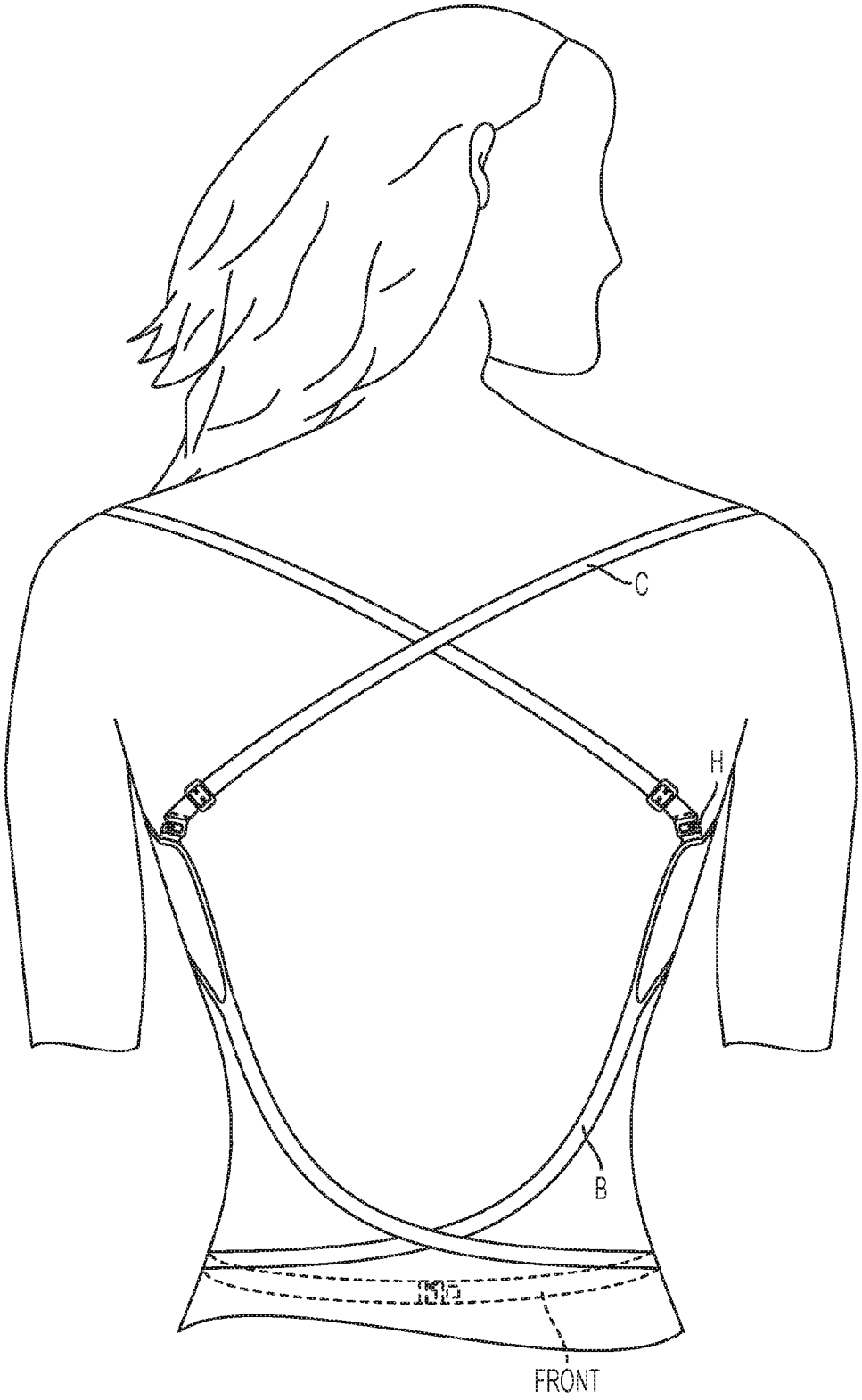
FIG. 4C is a rear view perspective corresponding to FIG. 1A design configuration (shoulder-strap/backless configuration) with a modification of alternating the shoulder straps in the back in a crisscross manner to adapt for a shoulder-strap: cross-back/backless design.

The bra comprises two form-shaping cups, each comprising a reinforcing underwire and each cup having an inward facing end and an outward facing end, wherein the inward facing ends of the cups generally face each other;

an under bust band underlying the form-shaping cups and which attaches to and connects the form-shaping cups;

two side portions, one connected to the outward facing end of one of the two cups and the other connected to the outward facing end of the other cup;

back body band straps extending to the lower back of the wearer and looping around to the front of the torso of the wearer, where the back body band strap ends join to couple for closure, and the back body band straps comprise a pair of length adjustment means for independently adjusting the length of the band to the circumference of the wearer; and at least one detachable and adjustable strap comprising a length adjustment means and securing means, detachably connected to the form-shaping cups and/or to the upper part of the unconnected ends of the side portions.

An optional front opening hook or clasp may be provided between and connected to the two cups in addition to the under bust band for cleavage adjustment if worn under a more revealing garment.

The bra can be made of any suitable material that is flexible and supportive. The cups are normally composed of conventional fabric used for bra manufacturing, such as cloth, lace, silk, net, transparent material or other desired materials, and maybe padded, and more preferably, substantially padded. The cups are preferably formed of a single piece of material, but may be fabricated from numerous pieces and layers. They may be ornamental or decorated. The cups maintain their contour or form by any convenient means, preferably by means of a reinforcing underwire. The underwire may be plastic or metal or any other suitable material.

The straps preferably are made of either stretchable elastic, conventional non-transparent fabric material with a non-slip backing, or made of a transparent or substantially transparent elastomeric polyurethane material, of which a wide variety are available in the marketplace such as the trade mark LYCRA™ (i.e., spandex). Preferred plastic materials may themselves be stretchable and light tinting may also be appropriate. The same applies to the material of the cups when they are also composed of transparent material. The straps include detachable securing means, which may be any means that can be easily attached or detached, such as clasps, hooks, eyes, buttons, loops, openings snaps, rings and other fasteners are used to allow either the shoulder straps to be fastened to the cups and the sides, if used, or one of the straps be fastened to each cup for a halter-neck design if desired. The straps also include length adjusting means, which may be any means that allows for the adjustment of the length of the straps, such as a sliding or adjustable ring or bracket.

The band comprises a front under bust band attached to and underlying the bra cups and bottoms of the two side portions and back band straps extending beyond the side portions to the back of the wearer and adapted to be wrapped about the waist of the user in opposite directions, terminating at the front of the user, where they are secured together in any convenient manner by a securing means, such as by clasps, hooks, eyes, buttons, loops, openings snaps, rings and other fasteners. The back bands are provided with length adjustment means, which may be any means that allows for the adjustment of the length of the straps, such as a sliding or adjustable ring or bracket. The band including the front under bust band, side portions and back band straps can be made of any suitable material that is flexible and supportive such as conventional bra manufacturing fabrics including lace, silk, net, transparent material or other desired materials.

Figure 5:
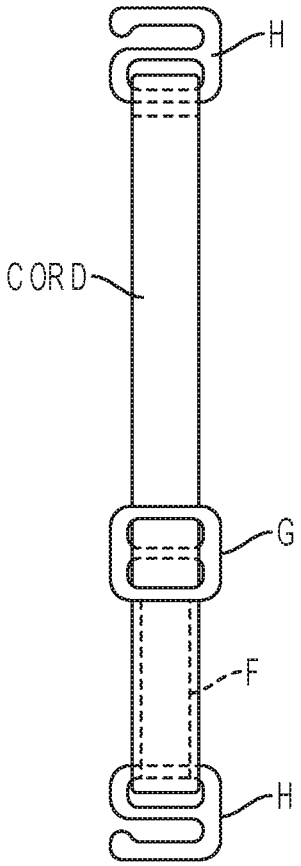
FIG. 5 is a plan view of a stretchable non-slip shoulder or a halter strap C.

Various adjusting means are employed on the shoulder, halter and back straps, so that the lengths of the straps may be adjusted as required. FIG. 5 shows the components of an exemplary embodiment of the detachable straps C which include the loop F at the end of the strap which connects to a hook H. An adjustable ring G allows for length adjustment, as the other end F the strap terminates in the terminal hook H for attachment to the other side of the bra. Detachable securing means may be any means that can be easily attached or detached, such as clasps, hooks, eyes, buttons, loops, openings snaps, rings and other fasteners are used to allow either the shoulder straps to be fastened to the cups and the sides, if used, or one of the straps be fastened to each cup for a halter-neck design if desired. Length adjusting means may be any means that allows for the adjustment of the length of the straps, such as a sliding or adjustable ring or bracket.

The transformation-associated method for dressing is provided contemplating an elastic strap (elastic means under tension removably retains the undergarment in the desired position) that is operably trained around a user's back and to be worn as a halter-neck for strapless configurations, or be worn as a shoulder strap with sleeveless configurations. A bra cup is attached at each end of the strap, with an adjustable attachment feature connecting the cups together. The side portions are constructed to provide maximum support of the breasts and minimum slippage of the bra.

The Figures show non-transparent underwire W form-shaping (push-up optional) cups A, each having an inward facing end I and an outward facing end J. The inward facing ends generally face each other and are connected together by a front under bust band K. There may also be an optional front-opening means such as a clasp or hook piece E for connecting the inward facing ends of the cups to allow for cleavage adjustment. This piece can be removed to offer more cleavage for front revealing gowns or can be attached to move the breasts towards the center of the chest to assist as a push-up function for the bra. The bra has two side portions L, one connected to the outward facing end of one of the two cups and the other connected to the outward facing end of the other cup.

The cups are provided with detachable shoulder straps C, preferably composed of a transparent plastic material, and a detachable halter strap D, also preferably composed of a transparent plastic material. Both the shoulder straps and the halter strap are provided with hooks H for attachment to the bra cups A. A front under bust band K is composed of either a conventional fabric material or a transparent plastic material and is attached to the bra cups and side portions. The back band straps B are adjustable in length and long enough to stretch backwards down and across the user's back, approximating at the lower portion of the back around the lumbar spine (the lumbar spine refers to the lower back, where the spine curves inward toward the abdomen) and sacral region (the sacral region is at the bottom of the spine and lies between the fifth segment of the lumbar spine (L5) and the tailbone), pulling the cups and loops around to the front of the torso, where it joins with the connecting hook H on one end, and fabric loop F at the other end of the band. The loop is preceded with a length-adjustable ring G.

The bra straps and band may also be secured using securing tabs (e.g., via any way now known or later developed such as adhesive, tape, hooks and eyes, hook and loop, etc.).

Also, only one shoulder strap can be removed or detached for a one shoulder backless configuration. In this embodiment, the bra includes one detachable shoulder strap, wherein one end of the detachable strap is connected to a top edge of one form-shaping cup and the other end is connected to a top edge of the corresponding side portion or the opposite side portion, to form a one shoulder-strap/backless configuration.

It should be noted that any part of the bra of the present invention may be made of a suitable transparent material.

It is contemplated that the constructions of the bra of the present invention may use any combination of nylon, cotton, spandex or any other suitable material and have any manner of lace, color or aesthetic design in its manufacturing. The detachable straps are secured by any suitable manner, including means of small metal or plastic hooks, fabric loops or snaps in its manufacturing. Additionally, various other adjustable constructions for use with various types of apparel such as sportswear, swimwear, evening gowns and formal wear, and casual wear including strapless, backless, one shoulder, and/or halter type designs or other convertible bra designs are also contemplated. Thus, although particular embodiments of the present invention of a new and useful convertible bra have been described, it is not intended that such references be construed as limitation upon the scope of this invention, except as set forth in the following claims.

What is claimed is:

1. A multi-adjustable strap configuration backless bra comprising:

two form-shaping cups, each comprising a reinforcing underwire and each cup having an inward facing end and an outward facing end, wherein the inward facing ends of the cups generally face each other;

an under bust band underlying the form-shaping cups and which attaches to and connects the form-shaping cups;

two side portions, one connected to the outward facing end at an upper side portion and lower side portion of one of the two cups and the other connected to the outward facing end at the upper side portion and lower side portion of the other cup, and which are attached to the under bust band;

body band straps being configured to extend and to loop around a circumference of a torso of a wearer, where the body band strap ends join to couple for closure, and each of the body band straps comprise a pair of length adjustment means for independently adjusting a length of the band to extend around the circumference of a torso of a wearer leaving a backless area; and at least one detachable and adjustable strap comprising a length adjustment means and securing means, is detachably connected to the form-shaping cups and/or to an upper part of the side portions.

2. The bra of claim 1, further comprising a front-opening component, which connects the inward facing ends of the form-shaping cups, to adjust cleavage.

3. The bra of claim 1, comprising two detachable and adjustable straps, wherein one end of each of the detachable straps is connected to a top edge of one form-shaping cup and the other end is connected to a top edge of a corresponding side portion, to form a shoulder-strap/backless configuration.

4. The bra of claim 1, comprising one detachable and adjustable strap, wherein one end of the detachable strap is connected to a top edge of one form-shaping cup and the other end of said detachable strap is connected to a top edge of the other form-shaping cup to form a halter-strap/backless configuration.

5. The bra of claim 1, comprising one detachable and adjustable shoulder strap, wherein one end of the detachable strap is connected to a top edge of one form-shaping cup and the other end is connected to a top edge of the corresponding side portion or the opposite side portion, to form a one shoulder-strap/backless configuration.

6. A multi-adjustable strap configuration bra comprising:

two form-shaping cups, each comprising a reinforcing underwire and each cup having an inward facing end and an outward facing end, wherein the inward facing ends of the cups generally face each other;

an under bust band underlying the form-shaping cups and which attaches to and connects the form-shaping cups;

two side portions, one connected to the outward facing end at an upper side portion and lower side portion of one of the two cups and the other connected to the outward facing end at the upper side portion and lower side portion of the other cup, and which are attached to the under bust band;

body band straps being configured to extend and to loop around a circumference of a torso of a wearer, where the body band strap ends join to couple for closure, and each of the body band straps comprise a pair of length adjustment means for independently adjusting a length of the band to extend around the circumference of a torso of a wearer; and two detachable and adjustable shoulder straps, wherein one end of each of the detachable straps is connected to a top edge of one form-shaping cup and the other end is connected to a top edge of the opposite side portion, and wherein the shoulder straps are configured to form a shoulder-strap alternating crisscross configuration.

* * * * *